United States Patent [19]

Beatty et al.

[11] 3,974,605

[45] Aug. 17, 1976

[54] WALL STRUCTURE AND SWIMMING POOL CONSTRUCTION

[75] Inventors: Gordon Wesley Beatty, Guelph; Douglas Charles Young, Toronto, both of Canada

[73] Assignee: Elcon Manufacturing Company Limited, Scarborough, Canada

[22] Filed: Nov. 22, 1974

[21] Appl. No.: 526,084

Related U.S. Application Data

[63] Continuation-in-part of Ser. No. 477,896, June 10, 1974.

[52] U.S. Cl. ..... 52/169 R; 52/309; 52/594

[51] Int. Cl.[2] ..... E02D 27/00

[58] Field of Search ..... 52/309, 594, 169, 593, 52/588, 584, 582, 615, 270

[56] References Cited

UNITED STATES PATENTS

| | | | |
|---|---|---|---|
| 2,230,393 | 2/1941 | Thomson | 52/309 |
| 3,111,569 | 11/1963 | Rubenstein | 52/309 |
| 3,397,496 | 8/1968 | Sohns | 52/309 |
| 3,416,165 | 12/1968 | Pereira | 52/169 |
| 3,427,662 | 2/1969 | Jacuzzi et al. | 52/309 |
| 3,440,780 | 4/1969 | Adam et al. | 52/169 |
| 3,487,599 | 1/1970 | Jansen | 52/309 |
| 3,736,599 | 6/1973 | Kessler et al. | 52/169 |

FOREIGN PATENTS OR APPLICATIONS

| | | | |
|---|---|---|---|
| 882,818 | 10/1971 | Canada | 52/309 |
| 1,293,043 | 4/1962 | France | 52/594 |
| 1,075,695 | 4/1954 | France | 52/563 |
| 1,000,616 | 8/1965 | United Kingdom | 52/309 |

*Primary Examiner*—Ernest R. Purser
*Assistant Examiner*—Carl D. Friedman
*Attorney, Agent, or Firm*—Neuman, Williams, Anderson & Olson

[57] ABSTRACT

Novel, plastic interlocking wall panels, having a high strength to weight ratio, are disclosed which are employed in a reinforced wall construction especially adapted for use in swimming pools. The wall panels and reinforced wall construction are characterized by their ability to be assembled in a strong, rigid unit without the necessity of employing bolts, fasteners or welding. Particularly, the construction in the most preferred embodiments employs structural elements prepared by the extrusion of plastic materials, and more particularly, plastic materials which have a cellular core of reduced density as a characteristic feature.

13 Claims, 13 Drawing Figures

FIG. 5
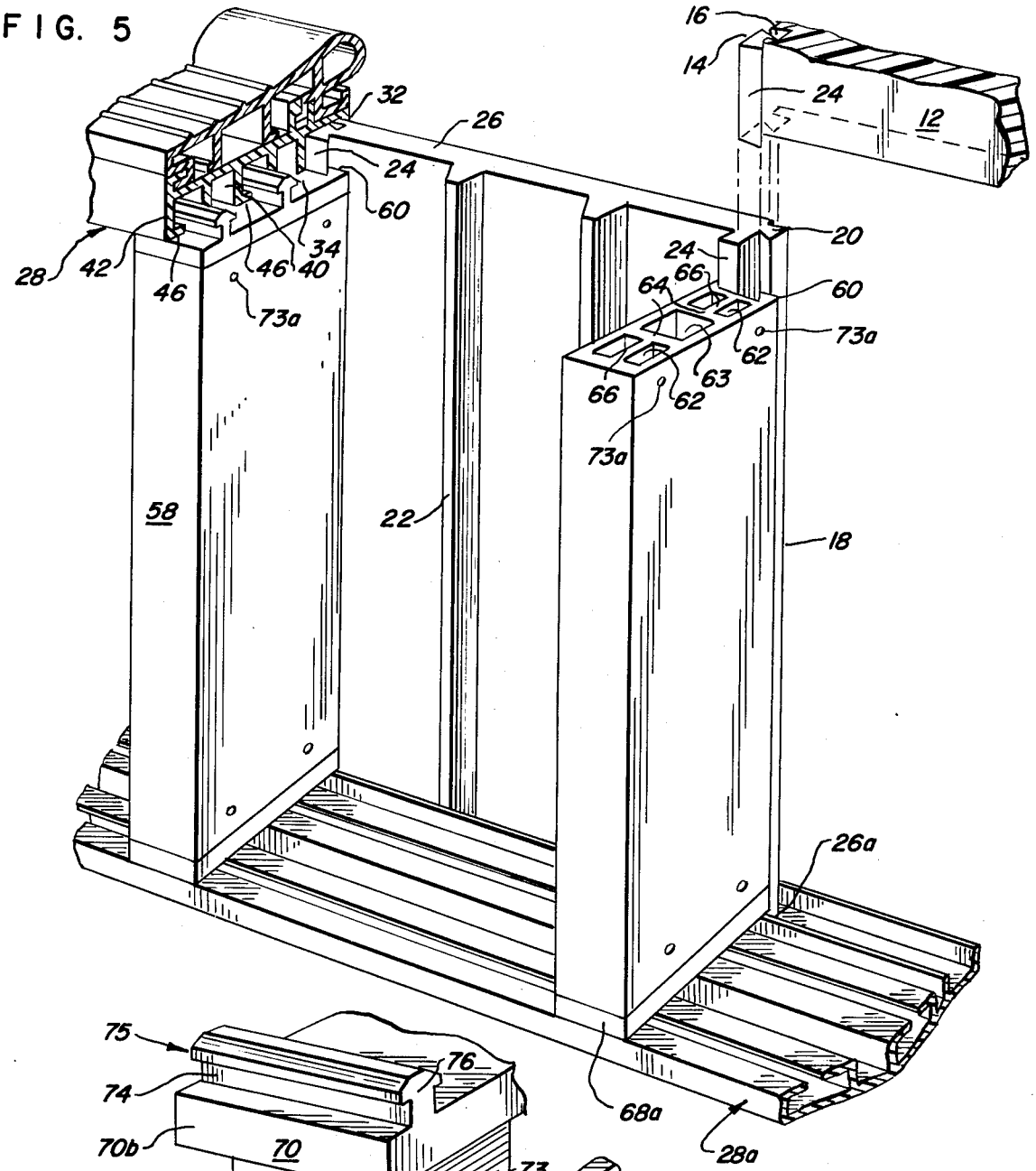
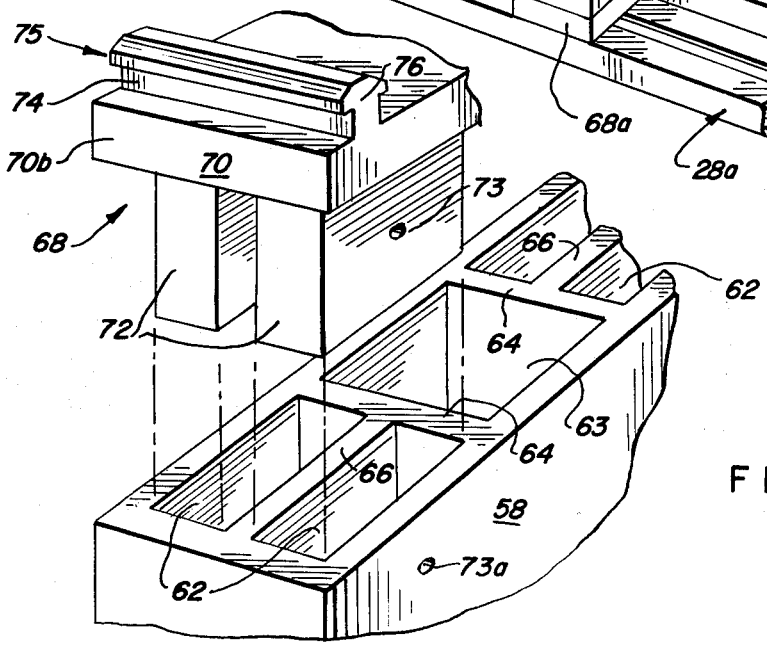
FIG. 4

WALL STRUCTURE AND SWIMMING POOL CONSTRUCTION

CROSS REFERENCE TO RELATED APPLICATIONS

This application is a Continuation-in-Part of our application Ser. No. 477,896, filed June 10, 1974.

BACKGROUND OF THE INVENTION

1. Field of the Invention

This invention relates to wall constructions and particularly wall constructions which may be employed in swimming pools and other related structures. The wall construction is further characterized by being fabricated of interlocking, compatible modular units whereby a wall structure of any particular size, or more specifically, vertical and longitudinal dimension may be readily manufactured by the use of these modular units.

2. Description of the Prior Art

Demountable or so-called portable basins and other structures, and especially swimming pool structures, have been the subject of considerable interest in recent years. Many of the so-called prefabricated and transportable basins or pools are designed for easy and ready on-the-site assembly and construction by minimally skilled workmen. Customarily, such constructions involve interconnection of a plurality of a similar modular, prefabricated wall units and additional supporting members which assemble either by interlock or by interlock and/or bolting. Ordinarily, for simplicity, they are constructed of a minimum of modular building or structural elements and the ultimate size and shape is variable depending upon how many of the modular units are assembled to make the particular structure. In the case of a swimming pool the length and the height of the swimming pool wall is ordinarily arbitrarily determined by the ultimate size desired with as many units being capable of assembly together to form any particular size of basin or pool as may be desired. Normally the height of the pool and the depth of water which is contained in the pool is a factor to be considered since the depth of pool determines essentially the head of water maintained within the vessel or chamber formed and this, in turn, imposes certain minimal strength requirements on the structure. Such demountable prefabricated pool constructions are disclosed in U.S. Pat. Nos. 3,641,595; 3,673,751; 3,736,599 and in Re. 26,977.

SUMMARY OF THE INVENTION

This invention relates to monolithic plastic interlocking wall panel sections adapted to form a continuous wall surface construction by interlocking assembly of the monolithic sections, said wall panel sections comprising in one form a rectangular monolith or panel of flat, strip-like configuration which, in a preferred embodiment, have a substantially greater length than width, said panel having an interior surface and an opposed reinforcing surface having formed thereon at least one and preferably a plurality of integrally formed reinforcing ribs extending longitudinally of said monolith in the longer dimension thereof and generally parallel to the edges of said panel. The monolithic panel is provided with integrally formed interlocking edge elements, including a first interlocking edge element comprising an elongated tongue or key strip which is essentially wedge-shaped in cross section and a second complementary interlocking edge element on the other side edge of the panel in the form of an elongated slot or groove. The slot or groove is formed so that the bottom of the generally U-shaped cavity is wider than the neck or opening and in one preferred form is generally wedge-shaped when viewed in cross section. The said first and second slot edge units on opposed side edges of each monolithic panel are manufactured for close sliding, interlocking engagement so that a plurality of the monolithic panels may be assembled together to form a wall structure.

The monolithic wall panel sections described above are formed by extrusion of a thermoplastic extrudable polymeric material of substantial thickness. In one preferred form, the polymeric material is of the so-called linear or isotactic type, particularly polyethylene and polypropylene. The core of the monolith viewed in cross section has a lower density than the outer surface. The reduced density of the core is obtained by extruding the monolith in a manner such that the core portion has a foam-like, cellular structure and the skin or outer surface is essentially noncellular and of normal density. The overall density or specific gravity of the monolithic panel ranges from about 0.4 to about 0.8, preferably in the case of polyolefins 0.45 to 0.5. The extrusion method by which this may be accomplished is described in Canadian Pat. No. 882,818 (1971) to Bontillier and assigned to Ugine Kuhlman Co. of Paris, France. The invention also includes a swimming pool construction which comprises:

a. a base and a top section in spaced apart opposed relation, each being provided with a plurality of longitudinally, generally parallel slots in facing relation, including a wall receiving slot;
b. a wall means extending between the base and top sections and disposed in the respective wall receiving slots thereof, said wall comprising a plurality of monolithic, generally elongated interlocking rectangular, thermoplastic cellular core wall panels, each of said panels having an interior surface and opposed reinforcing surface and provided with interlocking tongue and groove portions at the respective side edges thereof; and
c. a plurality of wall reinforcing support means extending rearwardly from the reinforcing surface of the wall section and extending between the top and base, said support element being provided with a slot means on one edge thereof in securing relation to the complementary interlocking edge portions of the monolithic wall panels.

In one preferred embodiment, the wall reinforcing support sections are each cooperatively connected with the base and top elements by means of an interlocking connecting unit which is adapted for frictional sliding and/or locking engagement with the top and bottom of the said wall support element. One form of interlocking means has a base which is provided with male members which are adapted for fitting engagement with corresponding female apertures or channels formed within the wall support element. The interlocking elements are also provided with generally T-shaped keys which extend from the base plate and the interlocking means in a direction opposed to said male members and are adapted for interlock with complementary key ways or channels formed in the top and base sections.

The wall construction may also include a coping plate or cap member adapted for interlocking fit with the top section and is provided with an upper footing surface. The coping is also provided on the forward edge thereof with a liner securing slot means which, when the wall construction is assembled, is adjacent the top of the wall section, and adapted to secure a liner sheet which extends downwardly from the cap along the interior surface of the monolithic wall panels forming a waterproof pool surface.

The various interlocking modular elements employed in the wall construction of the present invention are preferably made of plastic elements which have been extruded or molded. If desired, extrusions may be made in the same manner as the wall elements, with surfaces which are of the normal density of the particular thermoplastic material employed in their manufacture and an inner cellular core (considering a cross section of said elements) which is of reduced density. The foam core extruded monolithic wall panels provide structural elements which have unique properties of strength, durable exposed surfaces, a high strength to weight ratio, and reduced cost. Generally, the plastics or polymers used are extrudable thermoplastics such as polyolefins which are generally considered of the so-called linear or isotactic types and may be exemplified by mainly linear polyethylene and linear polypropylene, but may also be others, such as polyvinyl type resins or ABS (acrylonitrile-butadiene-styrene) polymers.

BRIEF DESCRIPTION OF THE DRAWINGS

Reference is now made to the drawings wherein:

FIG. 4 is an enlarged fragmentary view of a top portion of the wall construction illustrated in FIG. 2 and particularly showing a fragment of the interlocking element and its relationship to a wall support element of the wall construction;

FIG. 5 is a perspective view of a portion of the wall construction in partial section;

Figure 1:
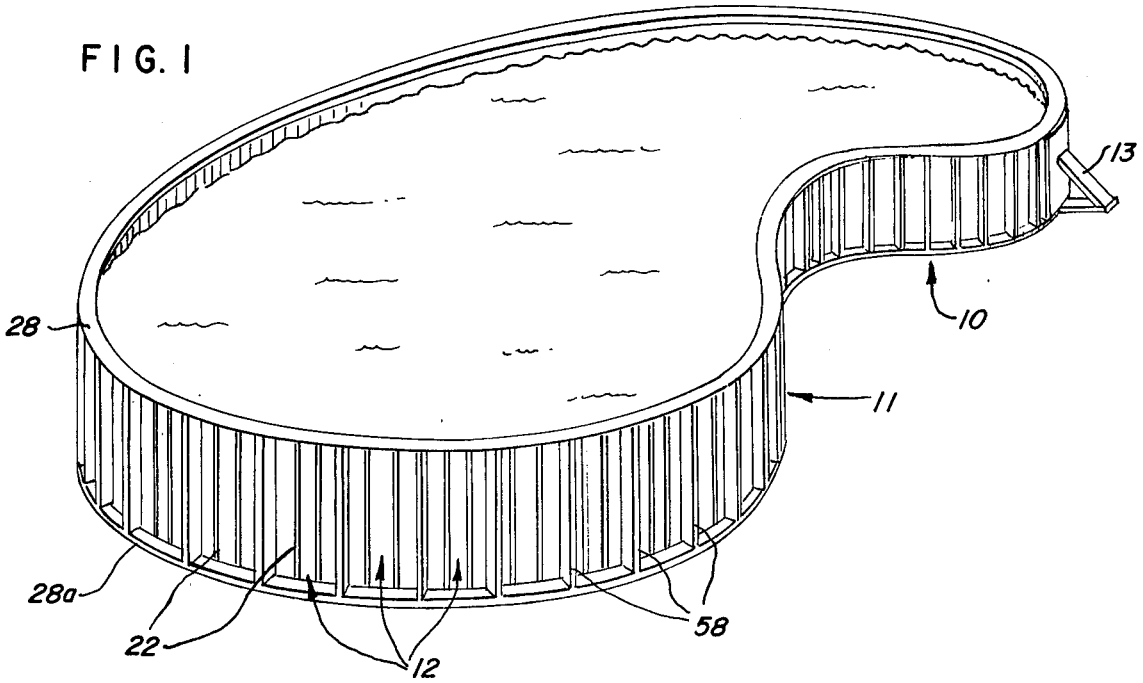
FIG. 1 is a perspective view of a swimming pool constructed in accordance with the present invention and employing the novel wall construction described herein.

Referring more particularly to the drawings, there is illustrated a swimming pool 10 of generally kidney shape employing the wall construction 11 of the present invention. The wall construction 11 includes a multiplicity of vertically disposed interlocking monolithic wall panel elements 12 illustrated in detail in FIGS. 2, 3, 5 and 6. The monolithic panels 12 are of a flat, strip-like generally rectangular configuration, having a substantially greater length than width and being provided with (as shown in FIG. 7) an interior surface 12*a* and an opposed reinforcing surface 12*b*. One vertical edge 14 of the panel 12 is provided with a groove or slot 16 and the other vertical side edge 18 of the panel 12 is provided with a corresponding tongue or key 20, complementary to the groove 16 so that a plurality of the panels 12 may be assembled in edge-to-edge interlocking relationship to form a wall construction. It is to be noted that the key or tongue 20 is generally wedge-shaped in cross section, the top surface of the wedge having a wider dimension than the base 20 or point of attachment 20*b* to panel 12. The tongue or key portion 20 is formed along edge 18 and spaced rearwardly from the interior or pool surface 12*a*. Edge 18 forms an essentially right angle surface 18*a* to the interior surface 12*a* and extends rearwardly therefrom to form an interlocking joint element 21 (FIG. 6) extending from the rear or reinforcing surface 12*b*. This interlocking element 21 has a rearward surface 21*a* disposed at an acute angle to both the surface 18*a* and the rear surface 12*b*.

The corresponding groove or key slot 16 formed along edge 14 is sized to provide a complementary fit with the key portion 20 on another and adjacent panel interlocking therewith to make a tight, secure interlocking joint. Groove 16 is formed by a generally L-shaped projection 17 extending from the reinforcing surface 12*b* and spaced inwardly from the edge 14 of panel 12. The key way of groove 16 is of generally U or wedge-shaped configuration in cross section with an opening 16*a* narrower than the bottom 16*b* and, as indicated, is adapted for fitting, interlocking relationship with the key or tongue 20. The rearward surface 17 of the L-shaped projection 17 is angled to provide an acute angle surface with both the reinforcing surface 12*b* and the edge surfaces 14 (which may be defined as a plane which includes the surface 14 of the edge element forming the groove 16).

The panels 12 are provided in one preferred form on their reinforcing surface 12*b* with a plurality of spaced-apart reinforcing ribs 22 integrally formed in the extrusion with the body of panel 12 and extending outwardly from the reinforcing surface 12*b* and are in the form shown generally trapezoidal in cross section with the longer base contiguous with surface 12*b*. The interior surface 12*a* of panel 12 is generally unobstructed and provides the interior pool structural surface.

Figure 3:
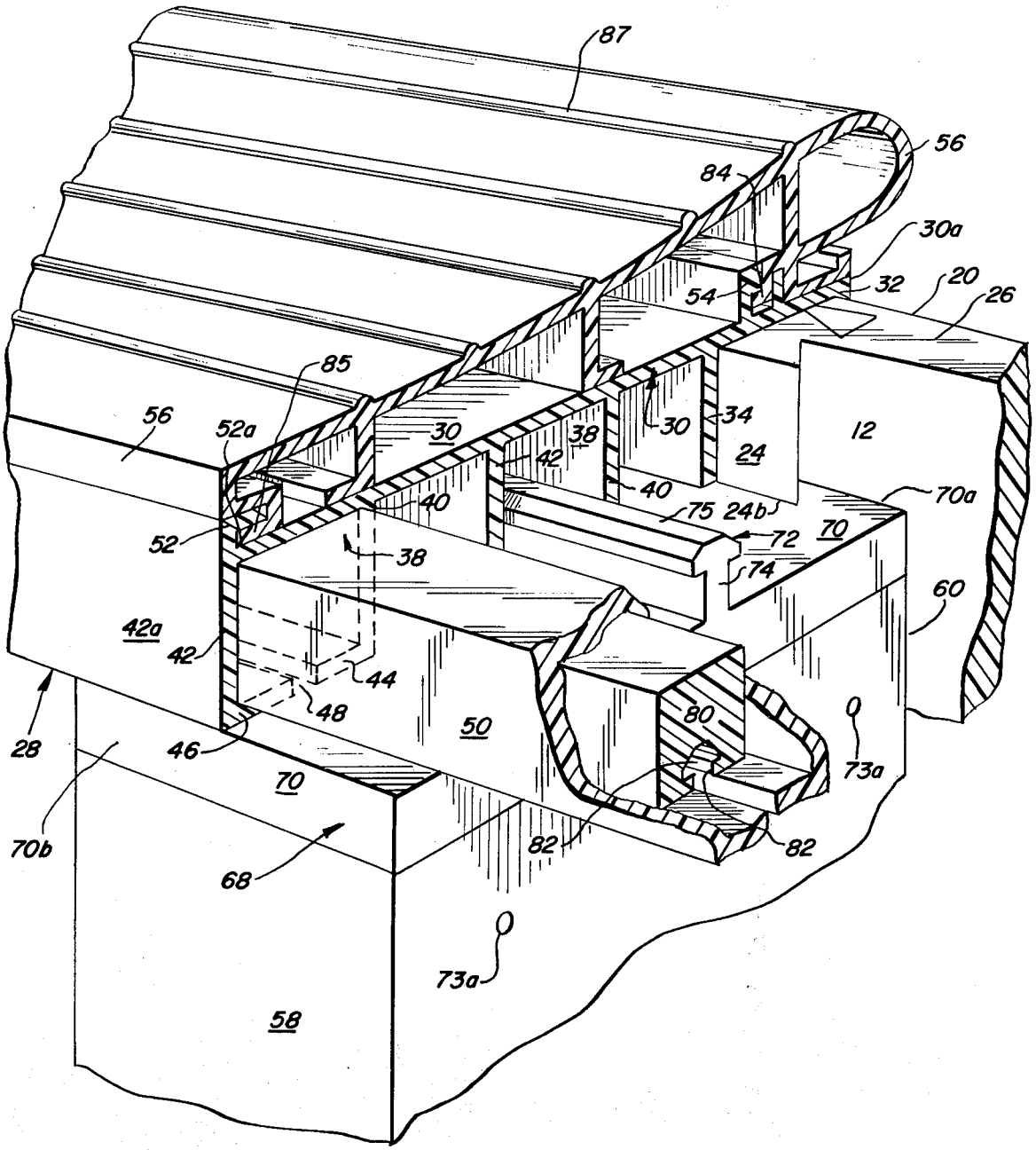
FIG. 3 is an enlarged perspective cross-sectional elevational view, partially broken away, of the upper portion of the wall structure illustrated in cross section in FIG. 2.
Figure 6:
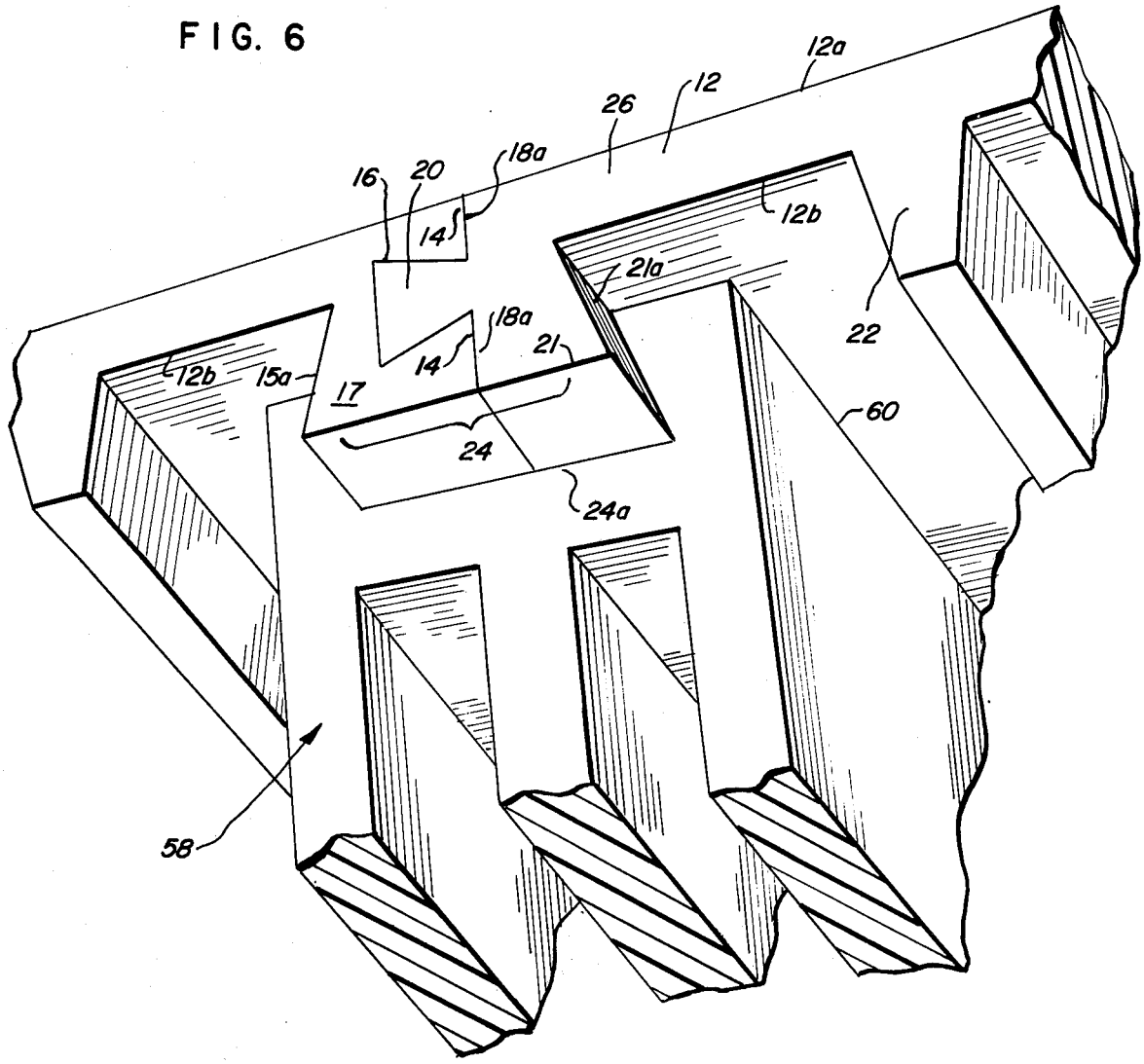
FIG. 6 is an enlarged cross-sectional, fragmentary perspective view of two interlocking wall panels.
Figure 7:
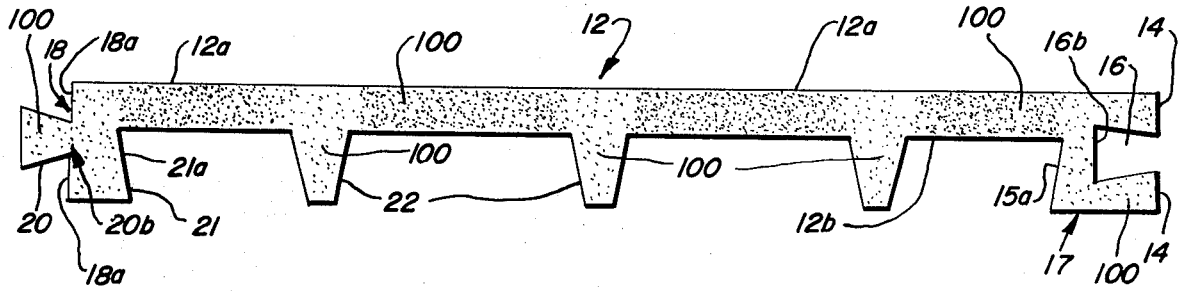
FIG. 7 is an enlarged cross-sectional view of a wall panel unit employed by the wall construction of FIGS. 1, 2, 3, 5 and 6.

When a plurality of the panels 12 are assembled as shown in FIGS. 1, 3, 5 and 6 of the drawings, the protruding abutments 21 and 17 together form a vertically disposed tongue or key element or joint assembly 24 which extends outwardly from the rear surface 12*b* of the panels 12 (see FIGS. 3 and 6). This key element has a dual function serving in one respect as a point of securement for the joints of panels 12 and a securing connection for the wall supporting elements 58 which are provided with a corresponding key way 24*a* which holds and secures projections 17 and 21. The tongue or key 24 is of generally wedge-shaped or trapezoidal cross-sectional configuration and also adapted for corresponding fit with the key way 24*b* of interlock member 68 (FIG. 3), 24*b* is also of a corresponding wedge shape.

Figure 2:
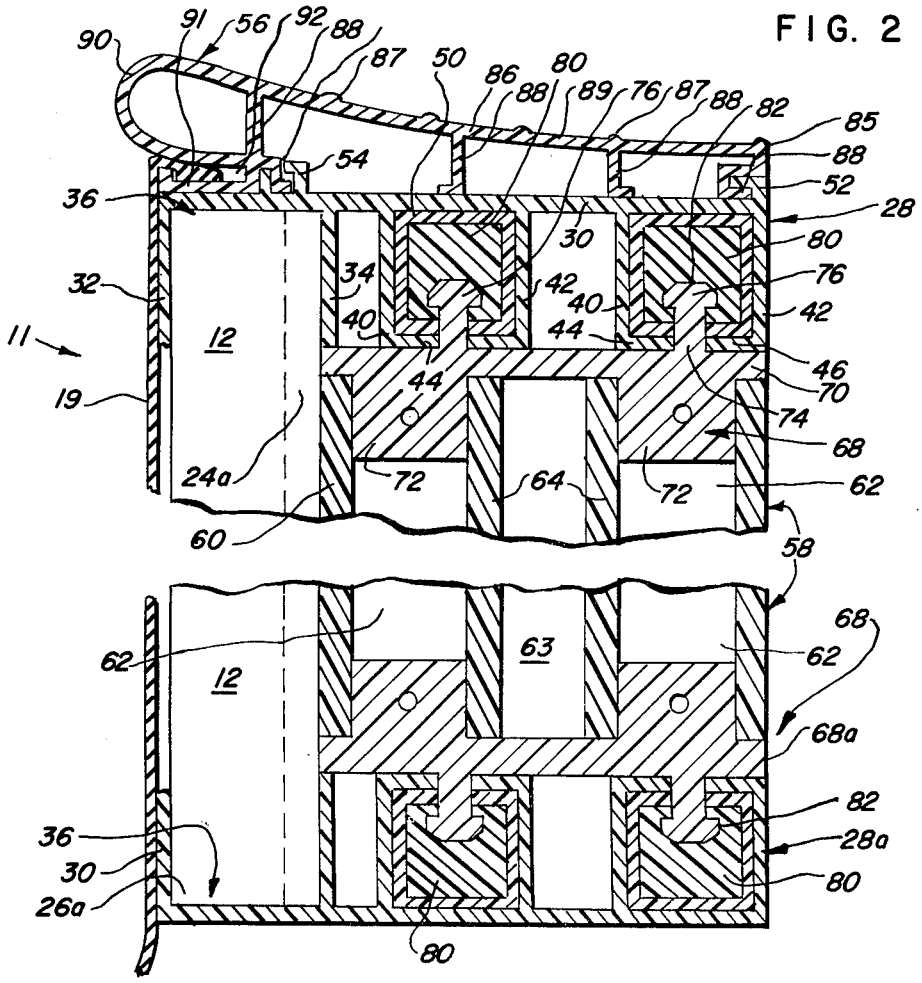
FIG. 2 is a vertical cross-sectional view of the wall construction employed in fabricating the pool of FIG. 1 taken along the lines 2—2 of FIG. 5.

The upper edge 26 of the assembled panel 12 is engageable with a top member generally denoted by the numeral 28 and illustrated more particularly in FIGS. 2, 3 and 5. The member 28 is formed with a base 30 which has downwardly extending spaced-apart ribs 32 and 34 which form a channel 36 at one end of the top member 28. The leg or wall sector 32 is at the terminus of the member 28 and leg 34 is spaced inwardly thereof, the spacing being such as to accommodate the upper edge 26 of the panels 12 (including ribs 22 and element 24) in the channel 36 formed by ribs 32 and 34, essentially normal to the surface defined by panels 12. A series of downwardly extending wall segments 40 and 42 are formed on the base 30 and form a series of generally parallel channels 38 extending parallel to the channel formed by legs 32 and 34. The most outward channel is at the terminus of the base 30 of member 28. The spaced-apart channels 38 formed by the aforesaid ribs are provided with normally disposed extensions or flanges 44 and 46 which run parallel to the base 30 and form a surface parallel to the base 30. These extensions are abbreviated and terminate to form a slot 48 at the mouth of the two channels 38.

The rear wall 42*a* of a member 28 is extended with a generally L-shaped flange 52 which rises above base 32 and extends inwardly a short distance above the base, generally in the direction of the wall panels 12. Flange 52 is designed to engage the rear flange 51 of a coping member 56 which extends forwardly and is spaced from and above the base 30. The forward portion of the base is provided with another and similar L-shaped flange 54 running generally parallel to the flange 52 and spaced rearwardly from the forward edge 30*a* of the base 30. The flange 54 provides a slot or groove 54*a* facing forwardly in the same direction as the slot formed by flange 52. This slot and flange assembly is adapted to engage complementary flanges disposed on the coping member 56.

A like constructed base member 28*a* receives the bottom edge 26*a* of the panel 12 and extends rearwardly therefrom in general parallel, spaced apart and opposed relationship to the top section 28. A generally rectangular support element 58 extends outwardly from the panels 12 and, more particularly, from the joint formed by interlock of the key 20 and slot 16 of the two edges 14 and 18 of the panels 12 which join to form composite abutment key 24 on the rearward surface thereof and generally extending normal to the surface of the walls 12. Element 58 spans the space between the top and base elements denoted by the numerals 28 and 28*a* and provides support for top section 28. One vertical edge 60 of the box-like support section 58 is provided with key way or groove 24*a* adapted to receive and secure the tongue or composite key abutment 24 at the joint and in the rear surface of panels 12. Referring to FIG. 4, support element 58 has two pairs of compartments 62 formed by transverse rib 64 and interconnecting longitudinal rib 66 which extend parallel to the side members 61 and 61*a*.

The element 58 is, in one preferred embodiment, formed by extrusion in the same manner as the panels. The cavities 62 and 63 extend continuously longitudinally throughout the unit.

A pair of interlocking elements or means 68 are provided for fitting and securing engagement between the top and bottom members 28 and 28*a* and the ends of support unit 58. These interlocking members denoted by the numerals 68 and 68*a* (at the bottom end of structure 58) have a rectangular base portion 70 which is shaped to conform with the top or bottom of the support element 58. The forward end 70*a* of the base 28*a* is provided with a groove 24*b* generally wider at the bottom than the top and adapted to fit in sliding locking arrangement with the abutment 24 and form an extension of the channel 24*a* on the forward edge 60 of the member 58. Rearwardly of the edge 70*a* are a pair of T-shaped key members 75 which extend upwardly of the surface of base 70 and are spaced generally parallel to the forward 70*a* and rear 70*b* of edges of base 70. The T-shaped members 75 as shown in FIG. 4 are formed by a rib 74 extending upwardly from base 70 surmounted by a head 75. The key members 75 are spaced on the base 70 to extend into the slots 48 and the channels 38 of the top member 28 and bottom member 28*a*, respectively.

The interlock member 68 is also provided with two pair of downwardly extending keys or legs 72 which are generally spaced apart rectangular forms which are sized to fit into the apertures 62 of support means 58 in close fitting sliding engagement. The rectangular legs 72 are as shown, generally at right angles to the direction of keys 75. The legs 72 have an aperture 73 formed therein and a pair of like apertures 73*a* is formed in and extends through the sidewalls of support element 58 communicating with channel 62. These apertures 73 and 73*a* line up axially when members 58 and 68 are assembled (as shown in FIG. 5) and a fastener or bolt (not shown) may be passed through them to secure the same. This may also serve as a point for securing the A-frame butress 13. The members 28 may be further connected together by a rectangular shaped bar 80 which has a channel 82 shaped to conform to head 76 of key 75 and lines up with slot 48 communicating with channel 38 in top section 28. This enables member 68 to be located in sliding engagement with bar 80 and top 28 and in turn will support means 58. In like manner, the base 28*a* and lower connecting unit 68*a* are joined to unit 58.

A coping section 56 is engageable with top section 28 by a pair of flanges 84 and 85 which are adapted for a snap fit with flanges 52 and 54 on top 28. Coping 56 is extruded with a top footing surface 86 having ribs 87 formed thereon for a suitable nonslip surface. A plurality of support legs 88 extend downwardly from the base 89 of top 56 and contact the upper surface of the base 30 of element 28. The forward edge 90 of coping 56 is formed into a nosing which, in conjunction with lip 91, forms a slot 92 which is adapted to receive the edge of a plastic liner 19 which may be disposed inside the pool structure providing a waterproof barrier for containment of water in a pool.

Figure 8:
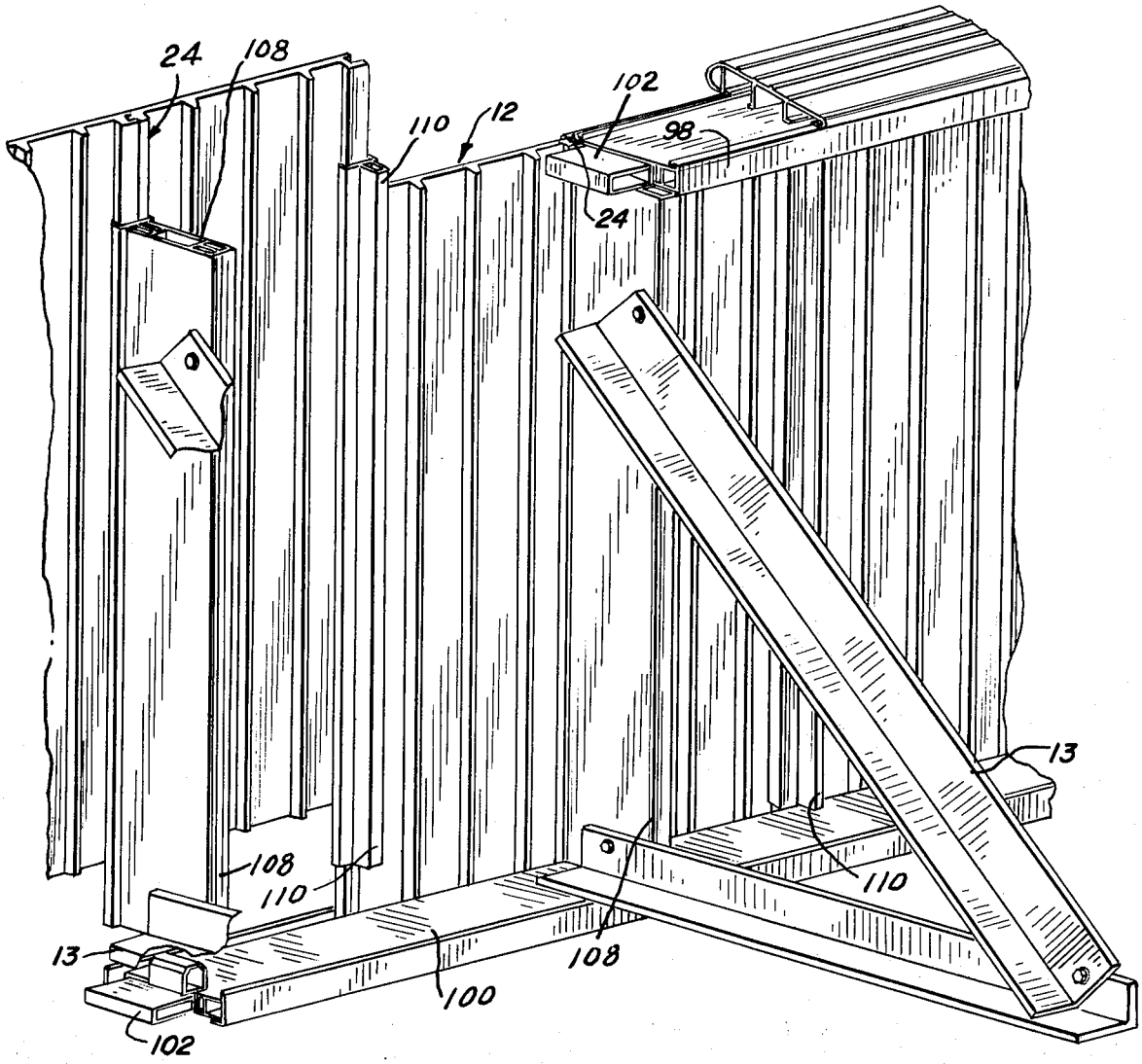
FIG. 8 is a partial perspective view of an alternate form of swimming pool construction.
Figure 9:
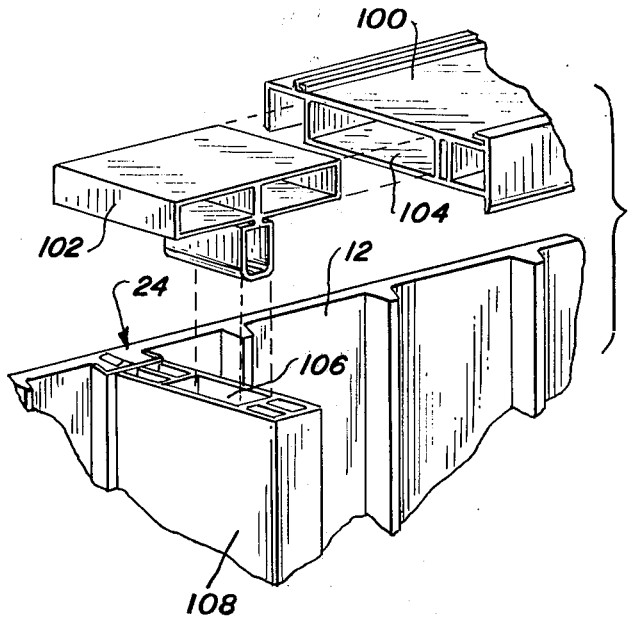
FIG. 9 is an exploded view of the interconnecting assembly of the top, wall, and support units shown in FIG. 8.

Reference is made to FIG. 8 which discloses an alternate embodiment of the invention, namely a wall panel 12, a top unit 98, a similar base or bottom unit 100 and a buttress 13 of an A-frame type. A T-chaped interlock or interconnecting unit 102 is shown which fits in channels 104 formed in top 98 and in the vertical channel 106 of the buttress or wall support element 108. FIG. 9 shows the assembly of these units in an exploded view. Similarly, unit 102 is used to connect base 100 with support 108. The A-frame buttress 13 is also shown in FIG. 1 and is used to provide additional support for the wall, especially in buried constructions. An intermediate clamp means 110 may be used to secure the joints 24 where support elements 108 are not required, and for example, means 110 and means 108 may be alternated in a typical wall construction.

Figure 10:
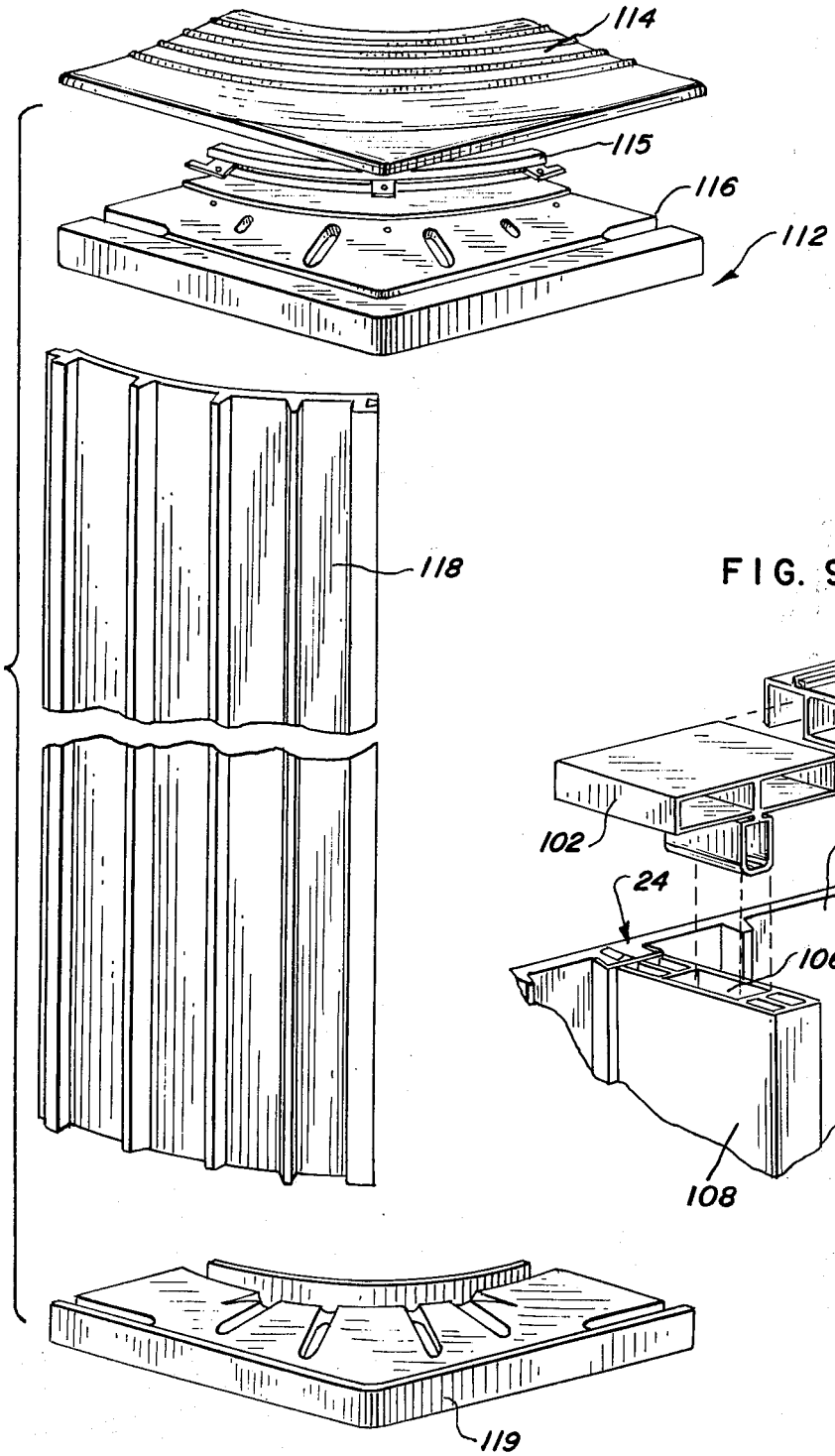
FIG. 10 is a perspective exploded view of the assembly for corners in a square construction of the pool construction of this invention.

FIG. 10 is an exploded view of a corner construction 112 which would be employed in a square pool construction. Shown in FIG. 10 are a coping 114, and a corner clip 115 which secures the liner and is affixed to corner top 116. A curved corner wall section 118 extends downwardly to a base corner unit 119 similar to unit 116 but channelled upwardly to receive curved wall 118.

Figure 11:
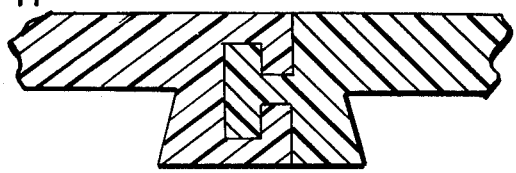
FIG. 11 is a fragmentary end view of another form of wall panel interlock.

FIG. 11 is a further embodiment of wall construction showing a T-shaped tongue and groove type interlock 120.

The panels 12 and certain other structural units forming a part of the wall construction 11 are preferably formed of plastic materials of substantial thickness, about ⅜ inch, and most preferably by extrusion of thermoplastic materials by a process which involves extrusion under conditions whereby the extruded item is formed with a cellular core of reduced density. This process is disclosed as indicated above in Canadian Pat. No. 882,818 (Oct. 5, 1971) to Boutillier.

The method involves the extrusion of the work in the form of a tubular body with a hollow cavity therein and an external surface thereon of an expansible plastic material in an unexpanded or partially expanded state through a die outlet, the amount of expansible material being sufficient to fill the hollow cavity when expanded, and feeding the extruded tubular body through an elongated shaper immediately adjacent the die outlet, the shaper having an internal surface defining a channel disposed substantially coaxially with the die and substantially with the shape and cross section of the final product required.

The product is chilled on its external surfaces to below the chilling point of the material immediately after being fed into the shaper channel, thereby forming a skin of high density material thereon imparting sufficient mechanical strength to pull the extruded product through the shaper and permitting concomitant expansion of the extruded material forming the tubular body toward the inside of the channel to fill the hollow cavity of the tubular body and to exert a positive pressure against the internal surface of the shaper.

Generally, the polymers employed are, as indicated, thermoplastic polymers, and for the items of the present invention they are preferably polyolefin, such as for example, polyethyene and polypropylene. These so-called linear polymers are often termed isotactic to refer to their particular structural characteristics which are achieved in the polymerization process. In general, these polymers are characterized by relatively high rigidity and strength, resistance to solvent and exposure to air and sunlight as well as chlorine and other chemicals which are commonly employed in the treatment of water used in swimming pools. The process described herein is also known in the industry as the Celuka Process which is a registered trademark of Produits Chimiques Ugine Kuhlmann of France, and employs certain self-expandable thermoplastics sold by that company under the tradename UGIKACEL. The basic patent to the process issued also in France, Pat. No. 1,498,620 (1967).

The modular panel units prepared by the foregoing process are illustrated in cross section in FIG. 7. The outer surfaces 12*a*, 12*b* and the surfaces of the ribs 22 and interlocking edge units, i.e., 20, 21, 17 are of the normal density of the polymer employed. The core portions designated by the numeral 100 are of reduced density which is achieved by the cellular or foam-like structure imparted to the core by the process described above. The introduction of the air cells in the core accomplishes several purposes of which are to provide a wall unit of substantial thickness and rigidity that is light in weight and produced at a reduced cost. The strength of the unit (flexural) is superior to a unit of the same general configuration formed of the same weight of unexpanded, polymeric material that has a uniform density throughout. The panels thus have a high strength-to-weight ratio. The overall density or specific gravity ranges from about 0.4 to 0.8, but preferably in the case of linear polyethylene extrusions are 0.45 to 0.5, or most preferably, 0.45 to 0.47. Generally, the overall density of the foam core units is about 40 to 80 percent of original normal non-expanded density of the thermoplastic used in the manufacture.

It should be understood that the expanded cellular core extrusions are those items which are adapted to be produced in any given length and are continuously formed at the extrusion dies in a theoretically infinite length.

The swimming pools or basins formed in accordance with the present invention are characterized by ease of assembly with a plurality of interlocking modular units. The units require few fasteners of the traditional type such as screws or bolts are the like and are characterized by resistance to corrosion and deterioration as compared to units constructed of steel.

Figure 12:
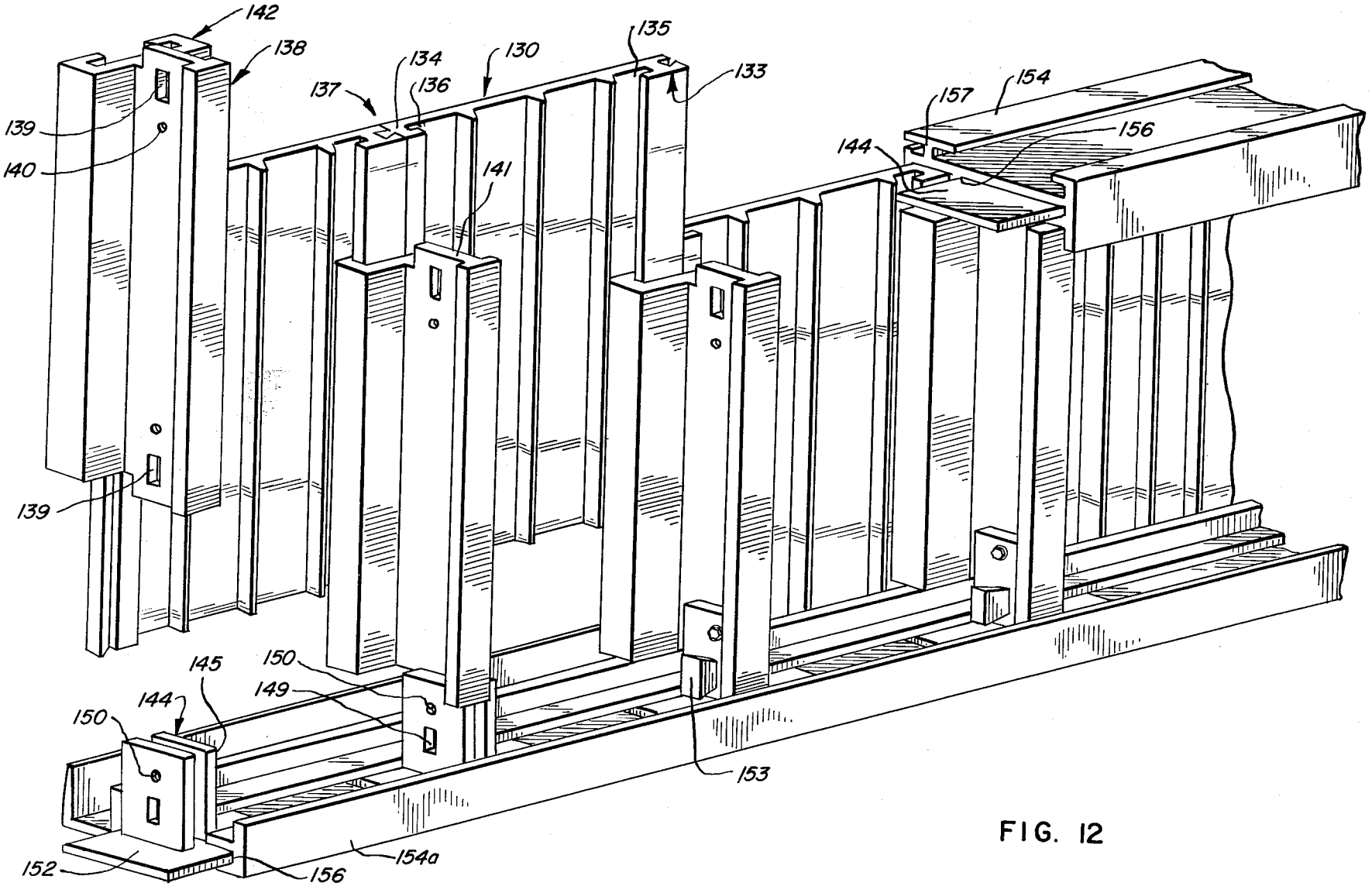
FIGS. 12 and 13 are perspective views of still another alternate form of swimming pool wall construction.
Figure 13:
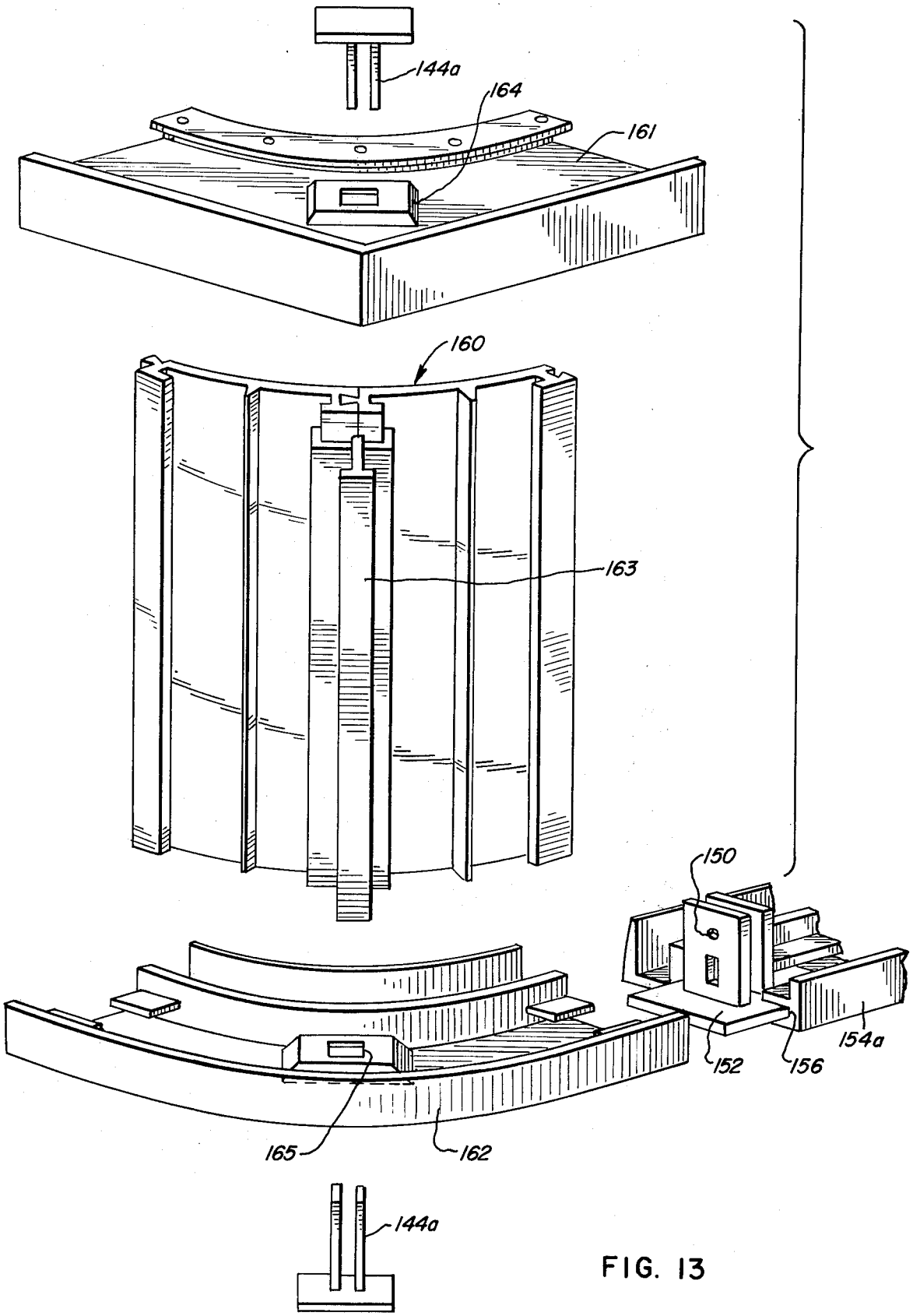

FIGS. 12 and 13 illustrate in perspective still another embodiment of swimming pool wall construction which is formed from foam core extruded elements and represents particular ease of assembly and formed of units which are particularly adapted to formation by the foam-core extrusion process described above.

In FIG. 12 there is illustrated in perspective the assembly of a wall unit. The wall construction employs a panel 130 which is similar to panel 12 except that the interlocking end elements 133 and 134 are provided with a longitudinal retaining and interlocking grooves 135 and 136 which are rectangular in cross-section. These are formed so as to mesh with modified wall reinforcing element 138 and together are a key element or joint assembly 137 similar to assembly 24.

Wall reinforcing element 138 is a foam core unit similar to the composite of units 58 or that of 108. Wall reinforcing element or buttress 138 is provided with apertures 139 and 140 formed in the web 141 extending rearwardly from the clasping portion 142. Aperture 140 is for a bolt or similar fastener and is used to join the A-frame support 13 with the buttress 138. Aperture 139 is rectangular in shape and is the same size as aperture 149 formed in T-interlock element 144. This T-interlock unit 144 is, as indicated, T-shaped, with a pair of rectangular spaced apart units 145 which are so spaced as to slip over web 141 of buttress 138, engaging opposite sides thereof as shown. Likewise, the apertures 149 and 150 formed in the element 145 match with the corresponding apertures (139 and 140) in web 141.

Apertures 139 and 149 together, when T-lock 144 and buttress 138 are assembled, form a rectangular channel in which a conforming wedge-shaped lock fastener 153 is driven to join the units together. The top portion 152 of the T-lock 144 is adapted to fit into the groove 156 to the top 154 and bottom 154*a* elements. This groove extends continuously in the section 154 which is also a foam core extruded element. Top 154 is provided with a slot which receives the wall units 130. Top unit 154 is provided with a longitudinal groove 157 which receives the liner sheet of the pool.

FIG. 13 is an illustration of a curved corner section 160 for joinder with the wall of FIG. 12, and shows the curved top 161 and bottom 162. The joinder of these elements is shown in the exploded view with a modified buttress 163 which is joined through T-locks 144*a* which slide through apertures 164 and 165 formed in the top and bottom corner sections. Buttress 163 may also be used in the wall shown in FIG. 12 where there is no particular need for the use of the A-frame supports 13.

It will be particularly noted that the embodiments of FIGS. 12 and 13 permit ready and simple assembly using fewer parts than the embodiments of FIGS. 1–10. Furthermore, the parts are readily made of foam core plastics by in-line extrusion.

What is claimed is:

1. A demountable swimming pool construction comprising a plurality of monolithic modular interlocking units which comprises:

a. a base section having a plurality of longitudinal, generally parallel, channels formed therein, including a wall receiving channel;

b. a top section of similar construction and spaced from the base section; and c. a wall section extending between the base and top sections and disposed in the said respective wall receiving channels thereof, said wall section comprising a plurality of monolithic, generally rectangular wall panel elements formed of thermoplastic material, the outer surfaces thereof being substantially the normal density of the thermoplastic material and the interior portion in cross section having a cellular core of reduced density, each of said panels having an interior surface and an exterior reinforcing surface having reinforcing ribs integrally formed thereon, and interlocking tongue and groove means on the respective opposed side edges thereof which are interlocked with other panels to thereby form a jointed, locked wall, the said tongue and groove means each having additional securing means extending rearwardly of the reinforcing surface to form an edge joint assembly, and a plurality of supplementary securing means having a slot means formed therein to secure the rearwardly extending joint assembly.

2. A demountable swimming pool construction comprising a plurality of monolithic modular interlocking units which comprises:

a. a base section having a plurality of longitudinal, generally parallel, channels formed therein, including a wall receiving channel;

b. a top section of similar construction and spaced from the base section; and c. a wall section extending between the base and top sections and disposed in the said respective wall receiving channels thereof, said wall section comprising a plurality of monolithic, generally rectangular wall panel elements formed of thermoplastic material, the outer surfaces thereof being substantially the normal density of the thermoplastic material and the interior portion in cross section having a cellular core of reduced density, each of said panels having an interior surface and an exterior reinforcing surface having reinforcing ribs integrally formed thereon, and interlocking tongue and groove means on the respective opposed side edges thereof which are interlocked with other panels to thereby form a jointed, locked wall, the said tongue and groove means each having additional securing means extending rearwardly of the reinforcing surface to form an edge joint assembly means, a plurality of supplementary securing clamp means having a slot formed therein complementary to a joint assembly means and in a securing relationship thereto, and a plurality of wall reinforcing support sections extending rearwardly from the wall and between the top and bottom sections and essentially normal to each, the said support sections having a slot means formed therein to secure an extended securing means of a joint assembly, the clamps and wall reinforcing support sections being affixed to the joint assemblies in a pre-determined sequence.

3. A swimming pool wall construction comprising a plurality of monolithic wall panel sections in an interlocking assembly relationship to form a wall, each of said panels comprising an elongated, rectangular monolith, having a top, bottom, opposed sides, and having an interior surface and an opposed exterior reinforcing surface, the reinforcing surface having integrally formed thereon at least one reinforcing rib means extending rearwardly thereof and essentially parallel to the edges thereof, said panel having interlocking edge elements integrally formed on each of the side edges thereof, the first of said interlocking edges comprising an elongated key means and the second of said edge elements comprising a complementary elongated slot means formed therein, said interlocking edge elements being removed from the plane of the interior surface thereof, the first interlocking edge unit having an integrally formed ledge-like support member on the one edge of the panel extending rearwardly from the reinforcing surface and at essentially right angles thereto and a wedge-shaped key means integrally formed on and affixed to the outer lateral surface of said ledge and spaced from the interior surface of the panel, the second complementary interlocking edge unit having an L-shaped configuration and spaced from the second side edge of said monolith, extending rearwardly thereof and having a wedge-shaped lateral slot means formed therein, the rearwardly extending members formed in the edge unit, providing in a plurality of assembled panels a means for supplementary securing of the joined panels; the first and second interlocking edge units being joined in close sliding interlocking relationship in a plurality of panels which are assembled to form a continuous wall structure, said panels being formed of a homogeneous thermoplastic material and having a thickness sufficient to provide a self-supporting structure, the exposed skin surfaces thereof being of substantially the normal density of the thermoplastic material used in fabrication and the core portion thereof being cellular and of reduced density, a cross section of the panel having a density gradient.

4. A swimming pool wall construction according to claim 3 wherein the panel reinforcing surface has a plurality of integrally formed reinforcing rib elements formed thereon in spaced parallel relationship to each other and the side edges of said monolith.

5. A swimming pool wall according to claim 3 wherein the thermoplastic polymeric material is a linear polyolefin resin.

6. A swimming pool wall according to claim 3 wherein the wall panel is formed of polymeric material of linear isotactic polyethylene resin.

7. A swimming pool wall construction according to claim 3 wherein the monolithic wall panel has a density of between about 0.4 and 0.8.

8. A swimming pool construction according to claim 3 wherein the wall panel is formed of linear polyolefin resin and has a density between about 0.4 and 0.8.

9. A swimming pool construction according to claim 3 wherein the monolithic wall panel is formed of linear polyethylene resin, said monolith having a density of from about 0.45 to about 0.50.

10. A demountable swimming pool construction comprising a plurality of monolithic modular interlocking units which comprises:

a. a base section having a plurality of longitudinal, generally parallel, channels formed therein, including a wall receiving channel;

b. a top section of similar construction and spaced from the base section;

c. a wall section extending between the base and top sections and disposed in the said respective wall receiving channels thereof, said wall section comprising a plurality of monolithic, generally rectangular wall panel elements formed of thermoplastic material, the outer surfaces thereof being substantially the normal density of the thermoplastic material and the interior portion in cross section having a cellular core of reduced density, each of said panels having an interior surface and an exterior reinforcing surface having reinforcing ribs integrally formed thereon, and interlocking tongue and groove means on the respective opposed side edges thereof which are interlocked with other panels to thereby form a jointed, locked wall, the said tongue and groove means each having securing means extending rearwardly of the reinforcing surface to form an edge joint assembly, and a plurality of wall reinforcing support sections extending rearwardly from the wall and between the top and bottom sections and essentially normal to each, each of said support sections having a slot means formed therein to secure the joint assembly and cooperatively secured to the base.

11. A swimming pool construction according to claim 10 wherein the said interlocking edge-joint assembly of the wall sections are formed with rearwardly extending elements on the reinforcing surface of each said wall element of a size and configuration complementary to and adapted to be secured by the slot in the support elements when the wall sections are joined in interlocking relationship.

12. A swimming pool construction according to claim 10 wherein the said thermoplastic wall elements are formed of extruded polyolefin polymers.

13. A swimming pool construction according to claim 10 which includes interconnecting assembly means for connecting the support section with the top and base sections, said support section, top and base having means for receivably securing the interconnecting assembly means.

* * * * *